US007418847B2

(12) United States Patent
Kosi

(10) Patent No.: US 7,418,847 B2
(45) Date of Patent: Sep. 2, 2008

(54) COMPACT FOLDING DEADBOLT RESTRICTOR

(76) Inventor: Marjan Kosi, 7841 Meadowood Dr., Burnaby, B.C. (CA) V5A 4E4

( * ) Notice: Subject to any disclaimer, the term of this patent is extended or adjusted under 35 U.S.C. 154(b) by 0 days.

(21) Appl. No.: 11/498,601

(22) Filed: Aug. 4, 2006

(65) Prior Publication Data

US 2007/0033973 A1 Feb. 15, 2007

Related U.S. Application Data

(60) Provisional application No. 60/708,090, filed on Aug. 15, 2005.

(51) Int. Cl.
*E05B 13/04* (2006.01)

(52) U.S. Cl. ..... 70/416; 70/430; 292/288

(58) Field of Classification Search ..... 70/211, 70/416, 429, 430; 292/258, 288, 339, 347, 292/DIG. 2

See application file for complete search history.

(56) References Cited

U.S. PATENT DOCUMENTS

| | | | | | |
|---|---|---|---|---|---|
| 2,463,195 | A * | 3/1949 | Mungan | 70/416 |
| 3,423,974 | A * | 1/1969 | Bernsley | 70/416 |
| 3,585,827 | A * | 6/1971 | Dominguez | 70/416 |
| 3,933,014 | A * | 1/1976 | Moses | 70/416 |
| 4,279,137 | A * | 7/1981 | Cook | 70/416 |
| 4,404,826 | A * | 9/1983 | Brill | 70/416 |
| 4,673,202 | A * | 6/1987 | Willis | 292/162 |
| 4,715,200 | A * | 12/1987 | Katsaros | 70/211 |
| 4,827,745 | A * | 5/1989 | Baugh | 70/416 |
| 5,007,263 | A * | 4/1991 | Taylor | 70/416 |
| 5,052,202 | A * | 10/1991 | Murphy | 70/211 |
| D397,025 | S * | 8/1998 | Kosi | D8/343 |
| 6,301,941 | B1 * | 10/2001 | Nicholsfigueiredo | 70/211 |
| 6,993,944 | B2 * | 2/2006 | Hicks | 70/416 |

* cited by examiner

*Primary Examiner*—Patricia Engle
*Assistant Examiner*—Christopher Boswell
(74) *Attorney, Agent, or Firm*—Oyen Wiggs Green & Mutala LLP

(57) ABSTRACT

An apparatus for preventing a deadbolt lock from being opened from the outside of a door with a key. The base is constructed from resilient material, the base defining at least one aperture for receiving one of a plurality of types of finger actuator in one of a plurality of orientations, the aperture shaped to prevent a finger actuator inserted therein from rotating relative to the base. A U-shaped plate is coupled to the base and is moveable between an extended position wherein the U-shaped plate is engageable with a member extending outwardly from the door and a storage position wherein the U-shaped plate is adjacent to the base. When a finger actuator is in the locked position and inserted into the aperture, and when the U-shaped plate is engaged with the member extending outwardly from the door, the finger actuator is prevented from moving into the unlocked position.

4 Claims, 7 Drawing Sheets fig 1A
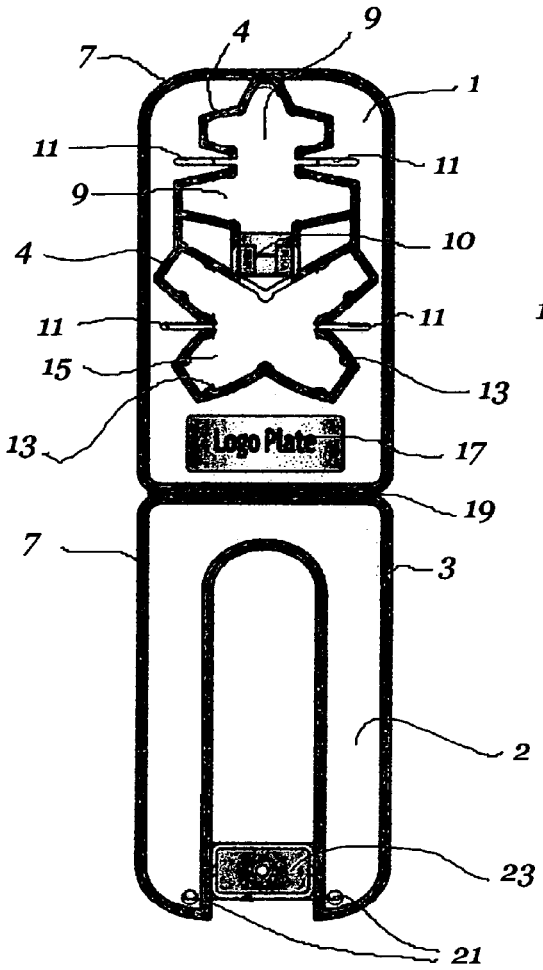
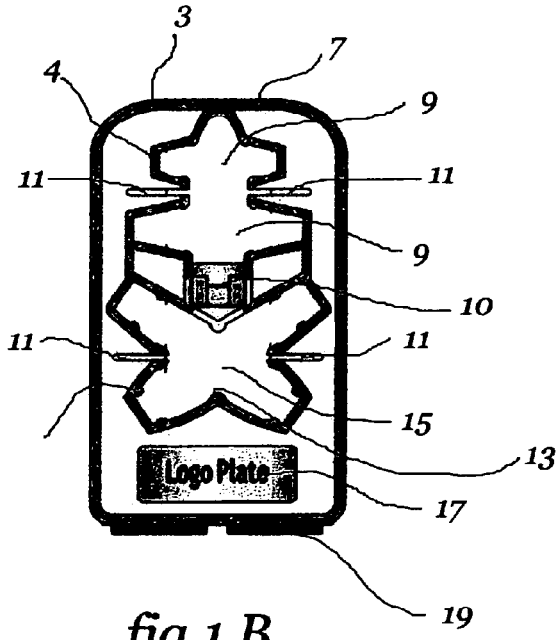
fig 1 B fig 3 A
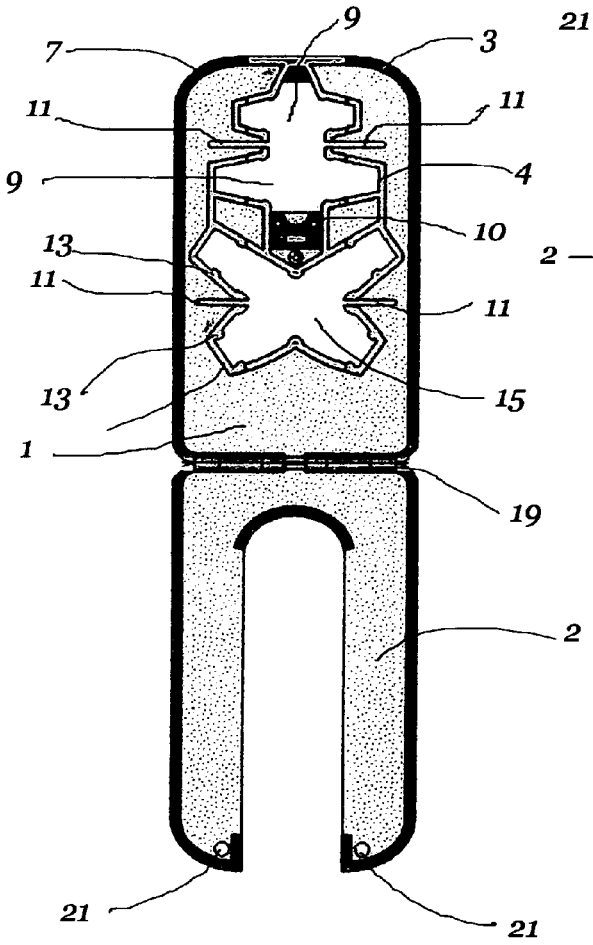
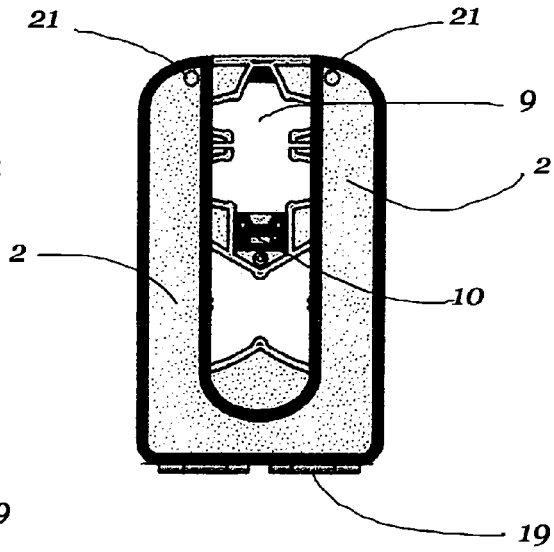
Fig 3 B fig 5 A
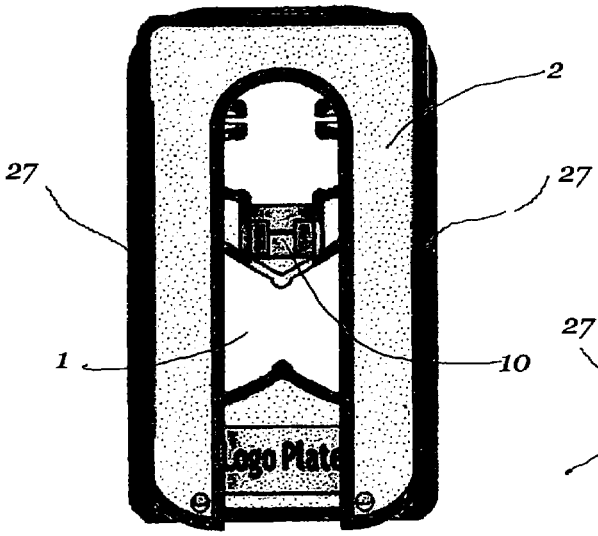
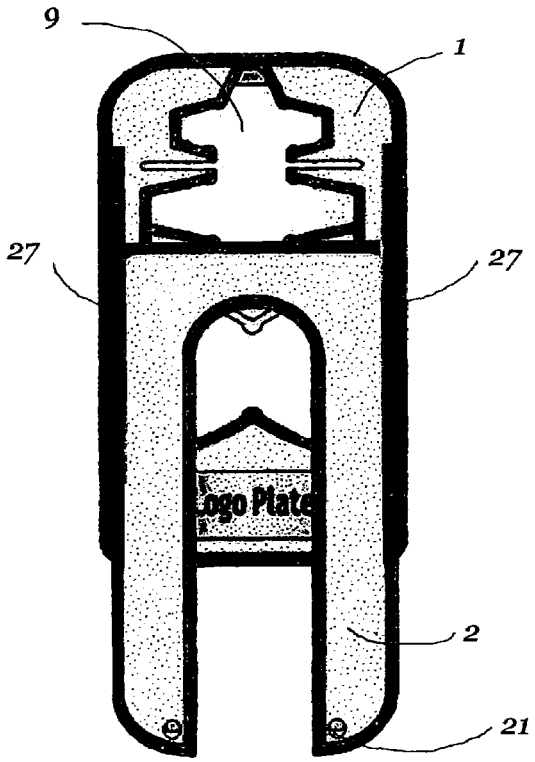
fig 5 B
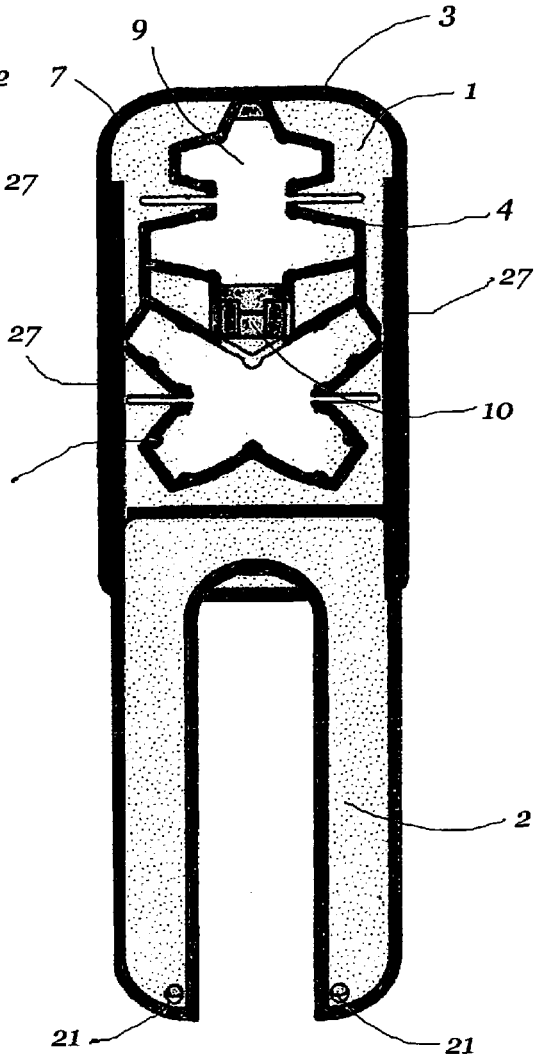
fig 5 C

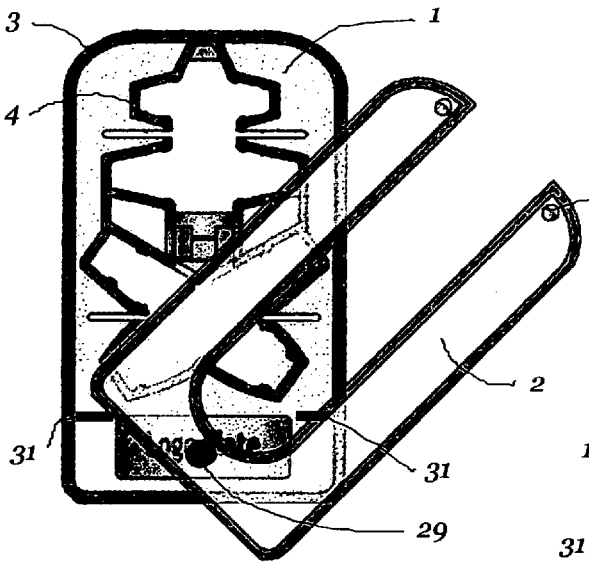
fig 6 B
fig 6 C
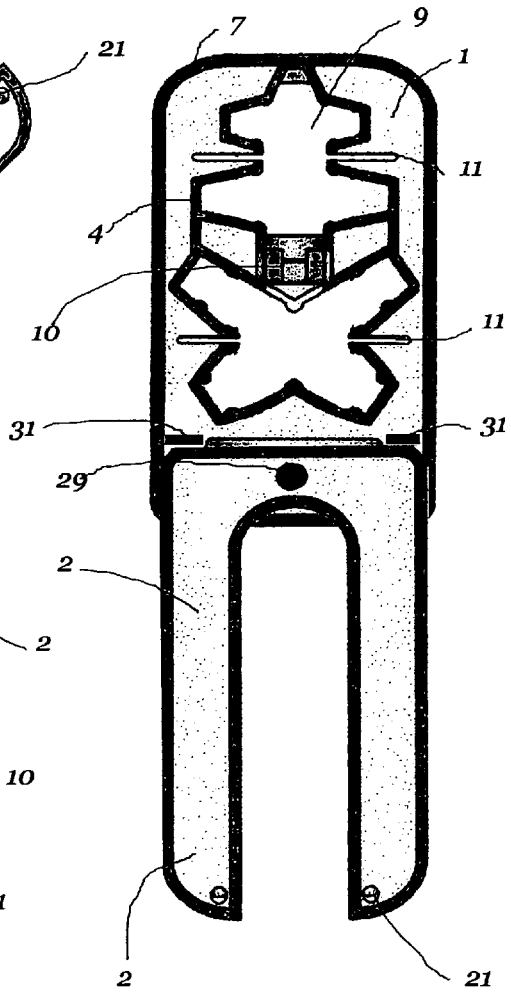
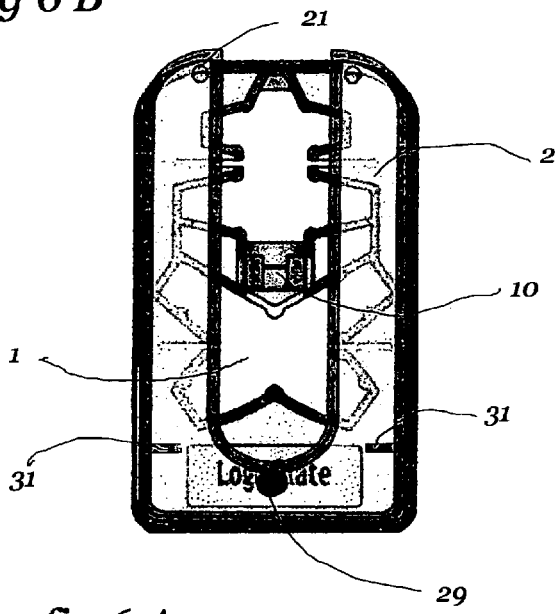
fig 6 A

COMPACT FOLDING DEADBOLT RESTRICTOR

This application claims priority to my U.S. provisional patent 60/708,090 filed on Aug. 15, 2005.

BACKGROUND OF THE INVENTION

1. Field of the Invention

The present invention relates generally to a device for securing a deadbolt latch, specifically to a device which inhibits the deadbolt latch from being turned from the outside with a key.

2. Background of the Invention

There has long been a desire for people to feel more secure within a dwelling than the security they are provided with by the activation of a deadbolt lock. In houses, hotels, apartments, or any dwellings in general, bars and other physical restraints may be used to completely secure windows as they do not require constant through access. Doors, on the other hand, are much more challenging to secure because they must be opened and closed regularly.

Deadbolts are surely the industry standard for quickly and easily securing a door. As a result, thieves and other notorious professionals have developed tools and skills to "pick" or quickly and easily deactivate and thus open deadbolts from the outside, putting one's personal security at great risk.

Keys themselves also have presented a substantial problem with home security. Much of the fear and worries felt by a person whose inner dwelling security feels compromised, stems from the concern over whether or not they hold the only keys to the deadbolt locks securing their dwelling. Certainly, in the case of tenants living in rental buildings, or hotel and motel occupants, additional keys to the deadbolt locks are held by the landlord or hotel management.

Additional rogue keys may also be held by cleaning staff, repair technicians, contractors, and in the case of apartments, even previous tenants. Thus for many people there is no clear sense of security felt from merely closing a deadbolt lock.

One of the most common products used in an effort to increase entrance security is a chain, ball and sleeve, or sliding piston. None of these accessories area as strong as a closed deadbolt however, and only come into use after a deadbolt has been bypassed. As well, such devices must be screwed to the door, making them not suitable for many applications where modifications to the existing building structure are prohibited and further impractical.

Consequently, inventors have created several types of devices to restrict deadbolts from being turned by a key or other device from the outside. Most of the devices work on the principle of partially encapsulating the deadbolt finger actuator and bracing it from being turned by further engaging the shank of the doorknob. This principle forms the basis of U.S. Pat. No. 4,279,137 COOK, and U.S. Pat. No. 5,052,202 MURPHY, which disclose variations of a thin flat plate with a hole to receive the deadbolt finger actuator as well as an integrated u shaped leg to brace the deadbolt actuator with the doorknob shank. U.S. Pat. No. 5,007,263 TAYLOR, works in a similar fashion but uses a separate u shaped bar and a double slot to engage either a key or the finger actuator.

While these devices do offer an additional measure of protection, they suffer from a number of disadvantages:

(a) They are of substantial dimension in order to span the distance between the doorknob shank and the deadbolt actuator. Consequently, they are bulky and hence not very portable—generally impractical to keep in the vicinity of a door, and even less practical to transport to other rooms or buildings during work, leisure or travel.

(b) They are awkward to use. Because of the setscrew and sliding sleeve, it is not immediately readily apparent how one would engage the device to a deadbolt and doorknob assembly.

(c) They work only with certain types of common deadbolt and doorknob configurations. Each major deadbolt manufacturer has a different shaped deadbolt finger actuator, and the previously described devices will not necessarily work with all of them.

(d) They require a doorknob to be present in order to work effectively. Since some doors use the deadbolt finger lever as a doorknob, the devices will not work at all in this situation.

(e) They are comparatively complex and costly to manufacture.

Still another type of device is described in U.S. Pat. No. 4,951,982 SORKILMO, and sold by J&L Distributors as "the Deadbolt Buddy". This device uses wedges that slip into the small space between the deadbolt finger actuator and the deadbolt plate. A thumb set screw is used to expand the wedge and thus jam the deadbolt actuator by way of friction between the wedge and the lock plate. Unfortunately, this device though comparatively compact with respect to the previously mentioned art, still suffers from the fact it is tricky to use, as well as relatively costly and complex to manufacture. It requires a tapped sleeve, a threaded rod, a rubber foot, and is therefore considerably more complex than the previously mentioned art.

Another problem with this type of device is that the user may over tighten the plastic thumb screw and thereby inadvertently strip the threads rendering the entire device inoperable. Furthermore, if a metal screw is used to reduce the risk of stripping the threads, then the over tightening could damage or pry off the actual deadbolt actuator finger lever.

SUMMARY

In accordance with the present invention, a compact portable folding device for restricting the piston and actuator movement of a deadbolt comprises a resilient molded plate with various shaped apertures, the apertures dimensioned according to leading lock manufacturers deadbolt finger actuator dimensions. The apertures are designed to stretch over the finger actuator of typical deadbolts, providing a snug friction fit.

Ideally, an integrated folding u shaped leg is provided which is hingeably connected to the resilient plate, the integrated unshaped plate folds out 180 degrees thereby doubling the length of the resilient plate. An optional hinged foot is further provided which swivels into one of the apertures modifying the profile of the cutout to fit still further lock manufacturer's actuators.

In use, the deadbolt restrictor is unfolded and pressed over the deadbolt actuator. The apertures act as a tight fitting sleeve to prevent the twisting motion of the deadbolt actuator. The variety of apertures in the top portion of the device accommodate the dimensions of all major deadbolt manufacturers finger actuators. The u shaped leg having been folded 180 degrees acts as a brace for the device by straddling the door knob shank and thereby preventing the entire unit form being rotated.

An optional adhesive coated foot removably attaches to the u shaped plate. In the event there is no doorknob, the optional adhesive coated foot acts to adhere to most door surfaces thereby bracing the device against any rotating motion.

DRAWING FIGURES—PREFERED EMBODIMENT

In the drawings, closely related drawings have the same number but different alphabetic suffixes. In the absence of isometric views, traditional front, rear, and side views follow:

FIG. 1A shows a front view of the unit opened, along with the optional bracket to be used if no doorknob is available.

FIG. 1B shows a front view of the unit closed

Figure 2C:
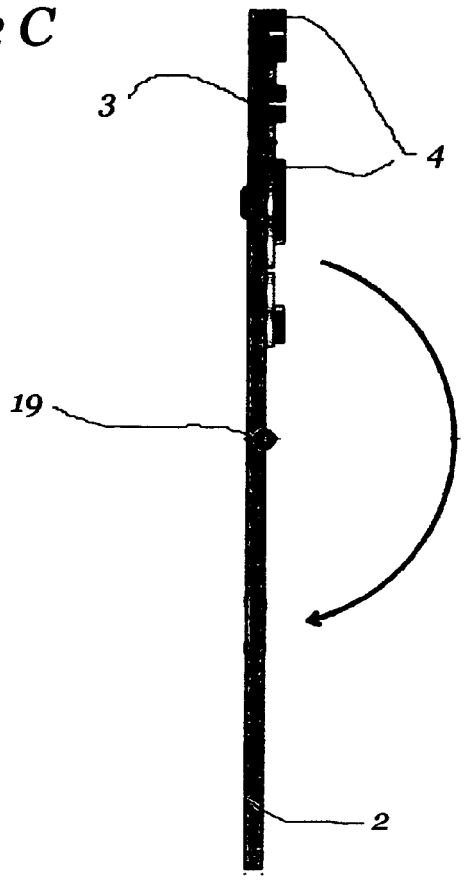
FIG. 2A shows a side view of the unit closed
Figure 2A:
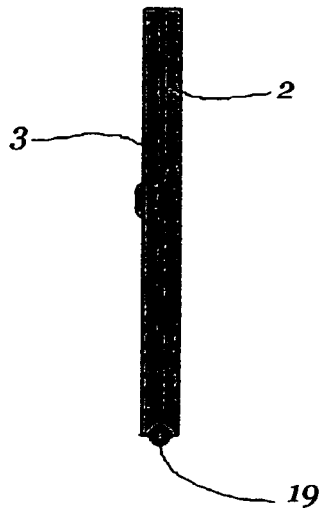
Figure 2B:
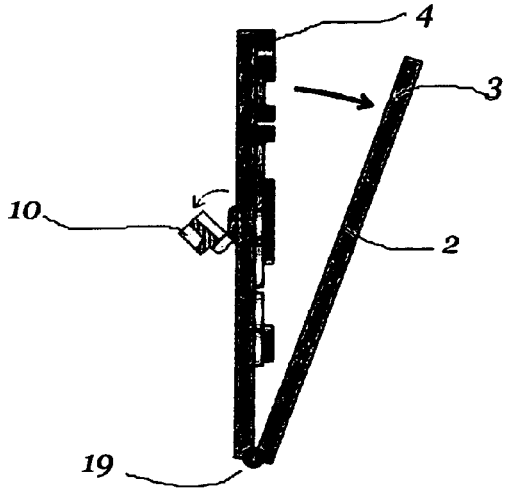

FIG. 2B sows a side view of the unit being opened

FIG. 2C shows a side view of the unit being opened all the way, 180 degrees.

FIG. 3A shows a rear view of the unit without the optional bracket

FIG. 3B shows a rear view of the unit closed.

Figure 4A:
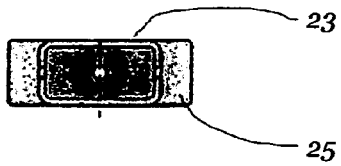

FIG. 4A shows the top of the optional bracket

Figure 4C:
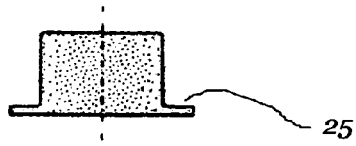
Figure 4B:
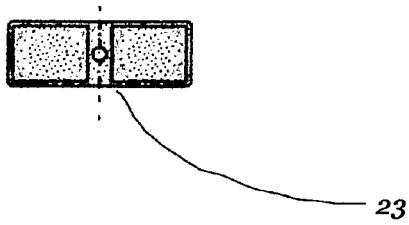

FIG. 4B shows the bottom of the optional bracket

FIG. 4C shows the front of the optional bracket.

Figure 4D:
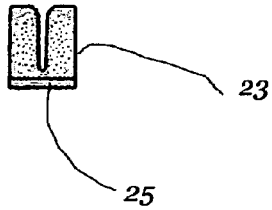

FIG. 4D shows the side of the optional bracket

DRAWING FIGURES—ALTERNATE EMBODIMENTS

FIG. 5A shows a top view of the sliding alternate embodiment in its closed position.

Figure 7A:
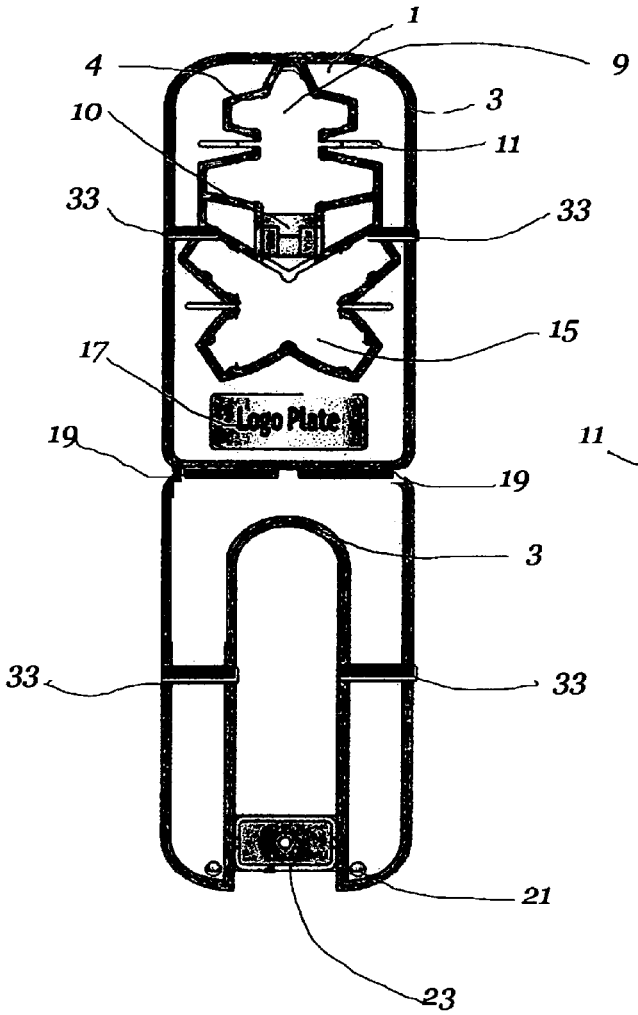

FIG. 5B shows a top view of the sliding alternate embodiment partially opened FIG. 5C shows a top view of the sliding alternate embodiment fully opened FIG. 6A shows a top view of the rotating alternate embodiment in its closed position FIG. 6B shows a top view of the rotating alternate embodiment partially opened FIG. 6C shows a top view of the rotating alternate embodiment fully opened FIG. 7A shows a top view of the accordion style folding alternate embodiment fully opened.

Figure 7B:
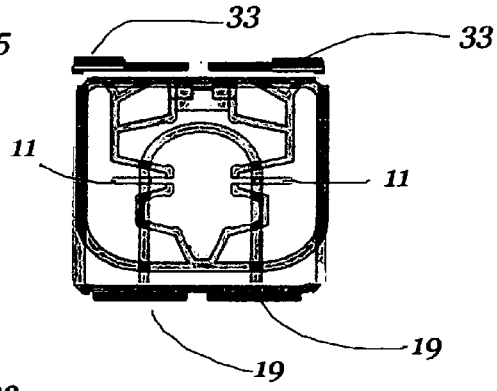

FIG. 7B shows a top view of the accordion style folding alternate embodiment completely folded closed.

DRAWINGS—REFERENCE NUMERALS

1 base
2 u-shaped plate
4 aperture ridge
3 uniform ridge
5 thickness of base
7 unitary face
9 aperture
10 pivoting member
11 slots
13 protrusions
15 lowest aperture
17 logo area
19 hinge
21 hole
23 optional bracket
25 protruding flange
27 channel
29 molded snap rivet
31 lip
33 additional hinges

DETAILED DESCRIPTION—PREFERRED EMBODIMENT

FIGS. 1 through 4 illustrate a preferred embodiment. The compact folding deadbolt restrictor is preferably made of thin resiliently injection molded plastic. Its base 1 is about 2 mm thick and is generally planar. The entire profile of base 1 may be surrounded in a uniform ridge 3 which gives supporting strength to the structure while still allowing base 1 to remain thin. Uniformed ridge 3 adds about 4 mm of material to the thickness 5 of base 1 but ridge 3 has a unitary face 7 of only about 3 mm.

Base 1 has a series of distinct apertures 9 to provide the necessary clearance for base 1 to snuggly slip over any major manufacturer's deadbolt finger actuator. The profiles of apertures 9 are also surrounded by an additional strength giving ridge 4 approximately 5 mm thick. Aperture ridge 4 further serves to push the unit a slight distance off the face 7 of the door allowing for proper spacing between the compact folding deadbolt restrictor and the door.

At least one additional aperture profile may be achieved by virtue of a pivoting member 10. Pivoting member 10 is hingeably attached to base 1 by way of an integrated molded hinge or a steel axel. When pivoting member 10 is swiveled into aperture 9, the shape of the aperture is different than from when pivoting member 10 is swiveled out. Thus, still further shapes of apertures 9 are integrated to accommodate an even wider variety of leading manufacturer's deadbolt finger actuators without increasing the overall dimensions of the compact deadbolt restricting device.

Base 1 has a series of slots 11 which fully penetrate ridge 3 and base 1. Slots 11 are short and extend only a minimal distance through base 1 after penetrating ridge 3. Slots 11 provide expansion room in base 1 when base 1 is stretched snuggly over a deadbolt actuating lever. Slots 11 provide a way of giving more spring action than the resilient characteristic of the plastic material alone can provide. As base 1 is stretched over deadbolt finger actuator, the plastic material will flex into the vacant space in base 1 provided by slots 11 thereby creating a friction tension fit between base 1 and the deadbolt finger actuator.

Apertures 9 have bump shaped rounded protrusions 13 which extend the full thickness of base 1 and ridge 3 and protrude about 1.5 mm into the vacant space created by apertures 9. Protrusions 13 create a controlled fixed high point in the perimeter of the aperture 9 profile and are thus able to ensure firm contact of the base 1 against the typically metal surface of a deadbolt finger actuator. Since these deadbolt finger actuators are often tapered, protrusions 13 ensure sufficiently snug contact is made between base 1 and deadbolt actuator regardless of the actuators potentially tapered shape.

Base 1 extends down below the lowest aperture 15 to allow sufficient distance to integrate branding of a logo within base 1. This logo area 17 further serves to provide enough plastic material giving sufficient strength to bear the hinge 19 to which the remaining structure of the unit attaches.

A u-shaped plate 2 may be provided which is hingeably connected to base 1. U-shaped plate 2 is also surrounded by the same structural ridge 3 as surrounds base 1. U-shaped plate 2 has the same dimensions as base 1 with the exception of vacant space in the center, thus forming the u shape. When the deadbolt restricting device is not being used, u-shaped plate 2 swivels 180 degrees to its closing point, and becomes invisible behind base 1 thereby reducing the length of the entire device by a factor of 2 and at the same time doubling the thickness. FIG. 2A shows the entire thickness of the device with u shaped plate folded all the way closed and mated behind base 1 to a total thickness of about 9.5 mm.

In use, u-shaped plate 2 functions as a brace by straddling the shank of a door knob and thus preventing the entire device from rotating. To keep the device as slim as possible, hinge 19 attaching u-shaped plate 2 to base 1 utilizes a steel spindle. Alternatively hinge 19 could be molded directly into the bottom perimeter of base 1 and u-shaped plate 2 and function identically. U-shaped plate 2 has at least 1 hole 21 at its end. Hole 21 is large enough to fit a fine cord, wire, string or chain through to provide a storage option whereby a user may hang the entire device from either the doorknob itself or hang it from some other household object such as a key rack.

An optional bracket 23 may be included which fits snuggly in the vacant air space of the u-shaped plate 2. The optional bracket 23 is about 30 mm deep and has a protruding flange 25 at its base 1. When slipped in behind and between u-shaped plate 2, the optional bracket 23 can firmly be positioned anywhere within the vacant channel of u-shaped plate 2. Optional bracket 23 has an adhesive pad or a hook or loop pad attached to flange 25. The purpose of the optional bracket 23 is to act as a stud removably attachable to the door in the unlikely absence of a door knob. Since optional bracket 23 fits between vacant channel of u-shaped plate 2, once flange 25 adheres to the door by virtue of adhesive or hook and loop, the entire compact folding deadbolt restrictor will be unable to rotate in the same manner as if it were engaged to the shank of a door knob.

Operation—FIGS. 1, 2, 3, 4

The manner of using the compact folding deadbolt restrictor begins with the user opening the unit by unfolding u-shaped plate 2. Next the user must be certain that the deadbolt finger actuator is in the locked position and that the door is actually closed and locked. If a typical deadbolt lock itself has been installed in the most common manner, the finger actuator will be in the horizontal position when the deadbolt is locked. Occasionally, a deadbolt may be installed upside down or off by 90 degrees. If this is the case, then the deadbolt actuator will be in the vertical position when the door is locked. In either case, the compact folding deadbolt restrictor will still work equally well, even with a deadbolt lock inversely described as above.

Once it has been confirmed that the door is locked, the user slips the unfolded u-shaped plate 2 down over the doorknob shank and firmly presses the opened deadbolt restricting device onto the deadbolt finger actuator, taking care to line up aperture 9 with the deadbolt finger actuator and thus encapsulate its edges. The device has now been successfully installed and will resist any and all twisting motion that may occur from unwanted attempts using a key or pick to gain entrance by unlocking the door from the outside.

In the event apertures 9 don't line up with the deadbolt finger actuator, pivoting member 10 may either be swiveled in or out to rectify the problem. By doing so, the profile of aperture 9 changes to accommodate this additional requirement.

In the unlikely case that there is no doorknob to act as a brace, optional bracket 23 is deployed as follows:

Firstly, the compact folding deadbolt restrictor is installed on the locked door as previously described above. Next, optional bracket 23 is slipped in behind u-shaped plate 2 and pushed through until flange 25 meets u-shaped plate 2. Finally, optional bracket 23 is firmly grasped and pressed on to the door. The adhesive begins to bond with the door, and when the unit is removed, the optional bracket 23 stays on the door to be ready for next use.

Optionally, there may be a layer of hook and loop between the base 1 of flange 25 and the adhesive. If this is the case, then the optional bracket 23 may simply be peeled of the door and stored with the rest of the unit, when not in use. The next time the unit is used, the hook or loop pad will already be in place on the door, ready to adhere to the optional bracket 23. In this case, to re-install the unit, first the optional bracket 23 is pressed on the hook or loop pad still on the door, and next the rest of the unit is installed as previously described.

To remove the compact folding deadbolt restrictor from the door, one pulls firmly on base 1 thus sliding aperture 9 off of the deadbolt actuator. Next, one lifts the unit guiding u-shaped plate 2 out engagement with the door shank.

Alternative Embodiments

As illustrated in FIG. 5A thorough 7B, there are various alternate possibilities of integrating the u-shaped plate 2 without the use of a hinge while still maintaining the compact quality and versatile performance of the preferred embodiment.

For example, FIG. 5A through 5C show a sliding u-shaped plate 2 coupled to base 1 by virtue of a channel 27 running down both longer edges of base 1. Sliding u-shaped plate 2 edges slide in channel 27 until they reach a stopping point. Channels 27 on base 1 provide additional supporting structure for base 1 and are molded into base 1. Of course channels 27 could be molded into sliding u-shape plate instead to achieve the same result. In either case 1, u-shaped plate 2 is able to perform equally well with the same end function and result as in the preferred embodiment.

Likewise, as illustrated in FIG. 6A through 6C, a non-hinged but swiveling u-shaped plate 2 could also be used with equally satisfactory results. Swiveling u-shaped plate 2 is connected to base 1 by way of a molded snap rivet 29. When swiveling u-shaped plate 2 is horizontally rotated 180 degrees, it locks into place by moving passed and dropping down behind a lip 31 molded into base 1. To fold back up, one lifts the corner and swivels u-shaped base 1 back in the opposite direction. The swiveling u-shaped plate 2 is able to perform equally well with the same end function and result as in the preferred embodiment.

Finally FIGS. 7A and 7B show a unit identical to the preferred embodiment, but with additional hinges 33 integrated into base 1 and u-shaped plate 2. This particular embodiment has the ability to be half as long when folded up, though twice as thick. In use, the unit must be unfolded four times before being installed. In this accordion style embodiment, once unfolded, the function and operation is identical to the function and operation of the preferred embodiment. Though twice as thick when folded closed, this embodiment is still only about 22 mm (¾) inch thick and only about 58 mm long making it very compact.

Accordingly, the reader will see that the compact folding deadbolt restricting device can be quickly and easily engage to most deadbolt locks and thereby completely restrict all twisting or turning motion resulting from a key or pick being used from the outside of the lock. In addition, it is equally easy for the user to remove from the device from the inside, and, when not in use, its folding compact nature make it convenient to keep in the vicinity of the door or to take traveling. Furthermore, the compact folding deadbolt restricting device has additional advantages in that

- Its compact folding nature gives it the ability to be thin, sleek, and highly portable.
- It is more likely to be used because of it's convenient shape and un-obtrusive dimensions
- It fits in a pocket, purse, or even a wallet, making it highly suited for securing locks in travel accommodations, where key history is of particular concern.
- It is fundamental in operation, and immediately obvious to an average person how to use.
- It functions well with all major manufacturers deadbolt finger actuators
- It is simple and inexpensive to mass manufacture being particularly suited for multi-cavity resilient injection molding.
- It will work acceptably in the absence of a door knob Its installation does not require any screws or threaded components, and will therefore never damage the door or the deadbolt finger actuator.

It is both attractive in appearance and convenient in function, thereby increasing potential consumer applications and scope of market for the product.

Although various embodiments have been described in detail, it should be appreciated that a variety of changes, substitutions and modifications will be apparent to those skilled in the art. Such alterations can be made without departing from the spirit and scope of the present invention and without diminishing its advantages. It is therefore intended that such changes, substitutions or modifications be covered by the following claims which define the spirit and scope of the invention:

The invention claimed is:

1. An apparatus for securing a door having a deadbolt, the deadbolt comprising a finger actuator moveable between a locked position and an unlocked position, the apparatus comprising:

a base constructed from a resilient material, the base defining at least one aperture for receiving one of a plurality of types of finger actuator in one of a plurality of orientations, the aperture shaped to prevent a finger actuator inserted therein from rotating relative to the base; and, a U-shaped plate coupled to the base, the U-shaped plate moveable with respect to the base between an extended position wherein the U-shaped plate is engageable with a member extending outwardly from the door and a storage position wherein the U-shaped plate is adjacent to the base, whereby when a finger actuator is in the locked position and inserted into the aperture, and when the U-shaped plate is engaged with the member extending outwardly from the door, the finger actuator is prevented from moving into the unlocked position, wherein the apparatus comprises at least one slot defined in the base and extending outwardly from the aperture, the slot positioned to allow a portion of the base adjacent to the slot to flex when a finger actuator is inserted through the aperture such that the portion of the base adjacent to the slot is frictionally engaged with the finger actuator.

2. An apparatus for securing a door having a deadbolt, the deadbolt comprising a finger actuator moveable between a locked position and an unlocked position, the apparatus comprising:

a base constructed from a resilient material, the base defining at least one aperture for receiving one of a plurality of types of finger actuator in one of a plurality of orientations, the aperture shaped to prevent a finger actuator inserted therein from rotating relative to the base; and, a U-shaped plate coupled to the base, the U-shaped plate moveable with respect to the base between an extended position wherein the U-shaped plate is engageable with a member extending outwardly from the door and a storage position wherein the U-shaped plate is adjacent to the base, whereby when a finger actuator is in the locked position and inserted into the aperture, and when the U-shaped plate is engaged with the member extending outwardly from the door, the finger actuator is prevented from moving into the unlocked position, wherein the apparatus comprises a pivoting member attached to the base adjacent to the at least one aperture, the pivoting member selectively moveable into an outer portion of the aperture, such that a first size of finger actuator is receivable in the aperture when the pivoting member is moved into the outer portion of the aperture, and a second size of finger actuator which is larger than the first size of finger actuator is receivable in the aperture when the pivoting member is moved out of the outer portion of the aperture.

3. An apparatus for securing a door having a deadbolt, the deadbolt comprising a finger actuator moveable between a locked position and an unlocked position, the apparatus comprising:

a base constructed from a resilient material, the base defining at least one aperture for receiving one of a plurality of types of finger actuator in one of a plurality of orientations, the aperture shaped to prevent a finger actuator inserted therein from rotating relative to the base; and, a U-shaped plate coupled to the base, the U-shaped plate moveable with respect to the base between an extended position wherein the U-shaped plate is engageable with a member extending outwardly from the door and a storage position wherein the U-shaped plate is adjacent to the base, whereby when a finger actuator is in the locked position and inserted into the aperture, and when the U-shaped plate is engaged with the member extending outwardly from the door, the finger actuator is prevented from moving into the unlocked position, wherein the at least one aperture comprises two apertures defined in the base, the two apertures comprising a first aperture shaped to accommodate vertically and horizontally oriented finger actuators, and a second aperture shaped to receive finger actuators oriented at a plurality of oblique angles, and wherein the first aperture comprises a first pair of horizontally opposed indentations positioned to receive a horizontally oriented finger actuator having a first horizontal size, a second pair of horizontally opposed indentations positioned to receive a horizontally oriented finger actuator having a second horizontal size which is greater than the first horizontal size, and a pair of vertically opposed indentations positioned to receive a vertically oriented finger actuator, the apparatus comprising a pivoting member attached to the base adjacent to one of the pair of vertically opposed indentations, the pivoting member selectively moveable into the adjacent vertically opposed indentation, such that a first vertical size of finger actuator is receivable in the aperture when the pivoting member is moved into the adjacent vertically opposed indentation, and a second vertical size of finger actuator which is larger than the first vertical size of finger actuator is receivable in the aperture when the pivoting member is moved out of the adjacent vertically opposed indentation.

4. An apparatus for securing a door having a deadbolt, the deadbolt comprising a finger actuator moveable between a locked position and an unlocked position, the apparatus comprising:

a base constructed from a resilient material, the base defining at least one aperture for receiving one of a plurality of types of finger actuator in one of a plurality of orientations, the aperture shaped to prevent a finger actuator inserted therein from rotating relative to the base; and, a U-shaped plate coupled to the base, the U-shaped plate moveable with respect to the base between an extended position wherein the U-shaped plate is engageable with a member extending outwardly from the door and a storage position wherein the U-shaped plate is adjacent to the base, whereby when a finger actuator is in the locked position and inserted into the aperture, and when the U-shaped plate is engaged with the member extending outwardly from the door, the finger actuator is prevented from moving into the unlocked position, wherein the U-shaped plate is foldably coupled to the base by a hinge, and wherein the base comprises two portions foldably coupled together by base hinge means and the U-shaped plate comprises two portions foldably coupled together by plate hinge means.

* * * * *